US012091851B2

(12) United States Patent
Lowery

(10) Patent No.: US 12,091,851 B2
(45) Date of Patent: Sep. 17, 2024

(54) STUDS WITH TRIANGULAR LONGITUDINAL CHANNELS

(71) Applicant: Arland Ray Lowery, Woodbridge, VA (US)

(72) Inventor: Arland Ray Lowery, Woodbridge, VA (US)

( * ) Notice: Subject to any disclaimer, the term of this patent is extended or adjusted under 35 U.S.C. 154(b) by 0 days.

(21) Appl. No.: 17/938,477

(22) Filed: Oct. 6, 2022

(65) Prior Publication Data

US 2024/0117634 A1 Apr. 11, 2024

(51) Int. Cl.

| | |
|---|---|
| ***E04B 2/78*** | (2006.01) |
| ***E04B 2/60*** | (2006.01) |
| ***E04B 2/74*** | (2006.01) |
| ***E04C 3/07*** | (2006.01) |
| ***E04C 3/32*** | (2006.01) |
| *E04C 3/04* | (2006.01) |

(52) U.S. Cl.

CPC ..... *E04B 2/789* (2013.01); *E04B 2/60* (2013.01); *E04B 2/7457* (2013.01); *E04C 3/07* (2013.01); *E04C 3/32* (2013.01); *E04C 2003/0443* (2013.01); *E04C 2003/0473* (2013.01)

(58) Field of Classification Search

CPC ..... E04C 3/32; E04C 3/07; E04C 2003/0443; E04C 2003/0473; E04B 2/60; E04B 2/7457; E04B 2/789

See application file for complete search history.

(56) References Cited

U.S. PATENT DOCUMENTS

| | | | | |
|---|---|---|---|---|
| 2,508,032 A | | 5/1950 | Kennedy | |
| 3,129,792 A | * | 4/1964 | Gwynne | E04C 3/09 52/634 |
| 3,396,499 A | * | 8/1968 | Biffani | E04B 1/2403 52/845 |

(Continued)

FOREIGN PATENT DOCUMENTS

| | | | | |
|---|---|---|---|---|
| CN | 104864258 A | * | 8/2015 | F16S 3/00 |
| CN | 108131553 A | * | 6/2018 | E04C 3/09 |

(Continued)

OTHER PUBLICATIONS

International Search Report and Written Opinion; PCT/US23/30421; Mailed Jan. 12, 2024.

*Primary Examiner* — Jessie T Fonseca

(74) *Attorney, Agent, or Firm* — Dunlap Bennett & Ludwig, PLLC; Anna L. Kinney

(57) ABSTRACT

A one-piece stud has a central longitudinal side; a first longitudinal side joined at a 90° angle to the first end of the central longitudinal side; and a second longitudinal side joined at a 90° angle to the second end of the central longitudinal side. The central side has a first and a second planar surface joined by an acute isosceles triangular channel midway between. The first longitudinal side is formed of a third and a fourth planar surface joined by an acute isosceles triangular channel midway between. The second longitudinal side has a fifth and a sixth planar surface joined by an acute isosceles triangular channel midway between. At an end opposite the 90° joint, the first longitudinal side and the second longitudinal side have free ends each forming a gapped right isosceles triangle. The longitudinal channels increase the axial capacity and the moment capacity of the stud.

9 Claims, 3 Drawing Sheets

(56) References Cited

U.S. PATENT DOCUMENTS

| | | | | |
|---|---|---|---|---|
| 3,653,172 | A | 4/1972 | Schwartz | |
| D257,639 | S | 12/1980 | Reid et al. | |
| 4,387,544 | A | 6/1983 | Schilger et al. | |
| 5,499,480 | A | 3/1996 | Bass | |
| 5,927,041 | A * | 7/1999 | Sedlmeier | E04C 3/07 52/39 |
| 6,374,558 | B1 | 4/2002 | Surowiecki | |
| 6,843,028 | B2 | 1/2005 | Weeks | |
| 6,993,881 | B1 | 2/2006 | Ruble et al. | |
| 7,818,925 | B2 * | 10/2010 | Benedict | E02D 27/02 52/426 |
| 8,056,303 | B2 * | 11/2011 | Frobosilo | E04C 3/32 52/852 |
| 8,186,112 | B2 | 5/2012 | Studebaker et al. | |
| 9,273,462 | B2 | 3/2016 | Black et al. | |
| 9,347,213 | B1 * | 5/2016 | Zhang | F16B 37/045 |
| 9,453,592 | B2 * | 9/2016 | Zhang | F16L 3/1033 |
| 9,580,900 | B2 * | 2/2017 | Zhang | E04B 1/388 |
| 9,856,642 | B2 | 1/2018 | Ukrainetz | |
| 9,938,709 | B2 | 4/2018 | Daudet et al. | |
| 10,161,127 | B2 * | 12/2018 | Zhang | E04C 3/09 |
| 10,808,404 | B2 | 10/2020 | Castellucci | |
| 2005/0257472 | A1 * | 11/2005 | Brady | E04B 2/7809 52/475.1 |
| 2008/0172978 | A1 * | 7/2008 | Caruso | E04B 2/60 52/716.8 |
| 2009/0183453 | A1 | 7/2009 | Koessler et al. | |
| 2010/0281821 | A1 * | 11/2010 | Frobosilo | E04C 3/09 52/846 |
| 2010/0287872 | A1 | 11/2010 | Bodnar | |
| 2014/0260083 | A1 * | 9/2014 | Zhang | F16M 13/027 52/843 |
| 2014/0283462 | A1 * | 9/2014 | Zhang | E04B 1/1903 29/897.31 |
| 2014/0283475 | A1 * | 9/2014 | Zhang | F16M 13/027 52/845 |
| 2015/0176631 | A1 * | 6/2015 | McCarthy | F16B 37/045 411/85 |
| 2015/0240486 | A1 | 8/2015 | Sacks et al. | |
| 2015/0275500 | A1 | 10/2015 | Dalla et al. | |
| 2016/0138261 | A1 * | 5/2016 | Zhang | E04B 1/388 29/897.3 |
| 2016/0138633 | A1 * | 5/2016 | Zhang | H02G 3/0608 24/456 |
| 2018/0171634 | A1 | 6/2018 | Mitchell et al. | |
| 2020/0095767 | A1 * | 3/2020 | Attalla | E04C 3/04 |
| 2021/0301530 | A1 | 9/2021 | Faridnia | |

FOREIGN PATENT DOCUMENTS

| | | | | |
|---|---|---|---|---|
| DE | 202004009267 | U1 * | 9/2004 | E04C 3/07 |
| FR | 2891288 | A1 * | 3/2007 | E04B 2/7457 |
| GB | 2585157 | A * | 12/2020 | E04B 1/40 |
| JP | H1181551 | A * | 3/1999 | |
| KR | 20210103681 | A * | 8/2021 | |

* cited by examiner

STUDS WITH TRIANGULAR LONGITUDINAL CHANNELS

BACKGROUND OF THE INVENTION

The present invention relates to building materials and, more particularly, to studs with triangular longitudinal channels.

Typical issues with "CEE" studs currently on the market are that their limiting height is often calculated out of building heights where a contractor must go up in gauges of stud or size. The limiting height is often overlooked in building services.

As can be seen, there is a need for a stud capable of supporting a taller structure without increasing the gauge.

SUMMARY OF THE INVENTION

In one aspect of the present invention, a unitary stud comprises a central longitudinal side formed of a first planar surface with a first end, a second planar surface with a second end, the first planar surface and the second planar surface joined by a central acute isosceles triangular channel midway between the first end and the second end; a first longitudinal side joined at a 90° angle to the first end of the central longitudinal side and having a third end opposite the first end, wherein the first longitudinal side is formed of a third planar surface and a fourth planar surface, the third planar surface and the fourth planar surface joined by a first side acute isosceles triangular channel midway between the first end and the third end, wherein the third end forms a first gapped right isosceles triangle; and a second longitudinal side joined at a 90° angle to the second end of the central longitudinal side and having a fourth end opposite the second end, wherein the first longitudinal side is formed of a fifth planar surface and a sixth planar surface, the fifth planar surface and the sixth planar surface joined by a second side acute isosceles triangular channel midway between the second end and the fourth end, wherein the fourth end forms a second gapped right isosceles triangle.

In another aspect of the present invention, a method of manufacturing a unitary stud includes providing an elongated metal sheet having a first longitudinal end and a second longitudinal end; forming a first bend a first length from the first longitudinal end; forming a second bend the first length from the first bend; forming a third bend a second length from the second bend; forming a fourth bend a third length from the third bend; forming a fifth bend a fourth length from the fourth bend; forming a sixth bend the third length from the fifth bend; forming a seventh bend the second length from the sixth bend; forming an eighth bend a fifth length from the seventh bend; forming a ninth bend the second length from the eighth bend; forming a tenth bend a sixth length from the ninth bend; forming an eleventh bend the second length from the tenth bend; forming a twelfth bend the fifth length from the eleventh bend; forming a thirteenth bend the second length from the twelfth bend; forming a fourteenth bend the third length from the thirteenth bend; forming a fifteenth bend the fourth length from the fourteenth bend; forming a sixteenth bend the third length from the fifteenth bend; forming a seventeenth bend the second length from the sixteenth bend; and forming an eighteenth bend the first length from the seventeenth bend.

The present invention provides a stud that reduces the material needed to build a wall and thus reduces the materials needed for a building. As the inventive stud outperforms commercially available studs, significantly less materials are needed to build a wall. The inventive stud increases the height of a wall that can be framed and strengthens the wall itself.

These and other features, aspects and advantages of the present invention will become better understood with reference to the following drawings, description, and claims.

DETAILED DESCRIPTION OF THE INVENTION

Figure 1:
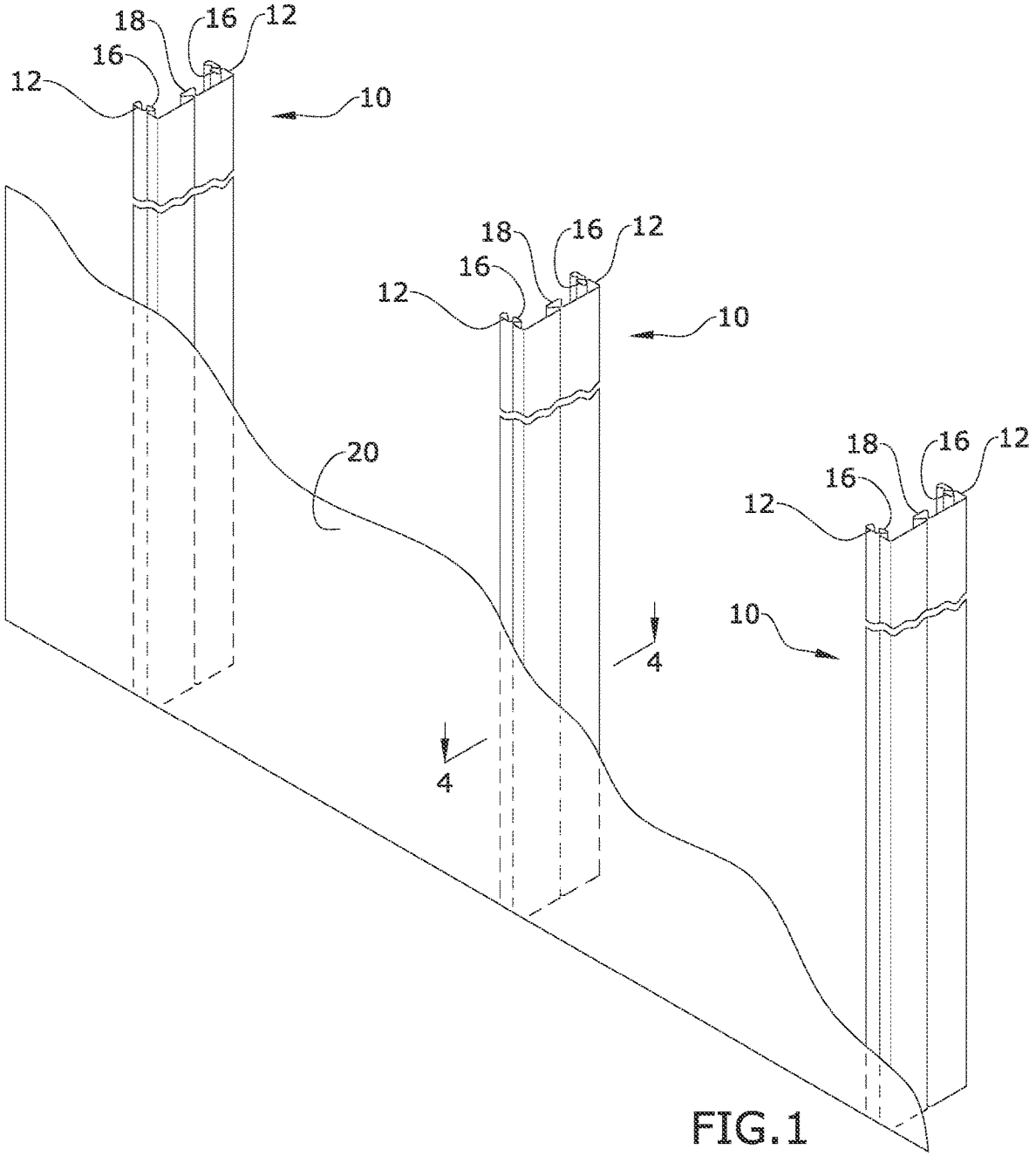
FIG. 1 is a perspective view of a convoluted profile stud according to an embodiment of the present invention, shown in use.
Figure 2:
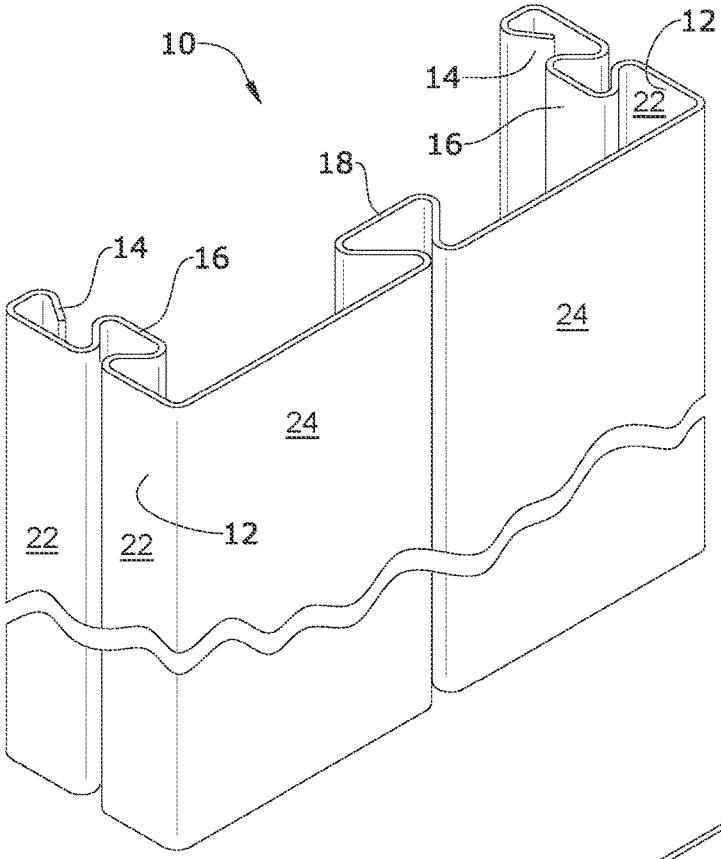
FIG. 2 is a detail perspective view thereof.
Figure 3:
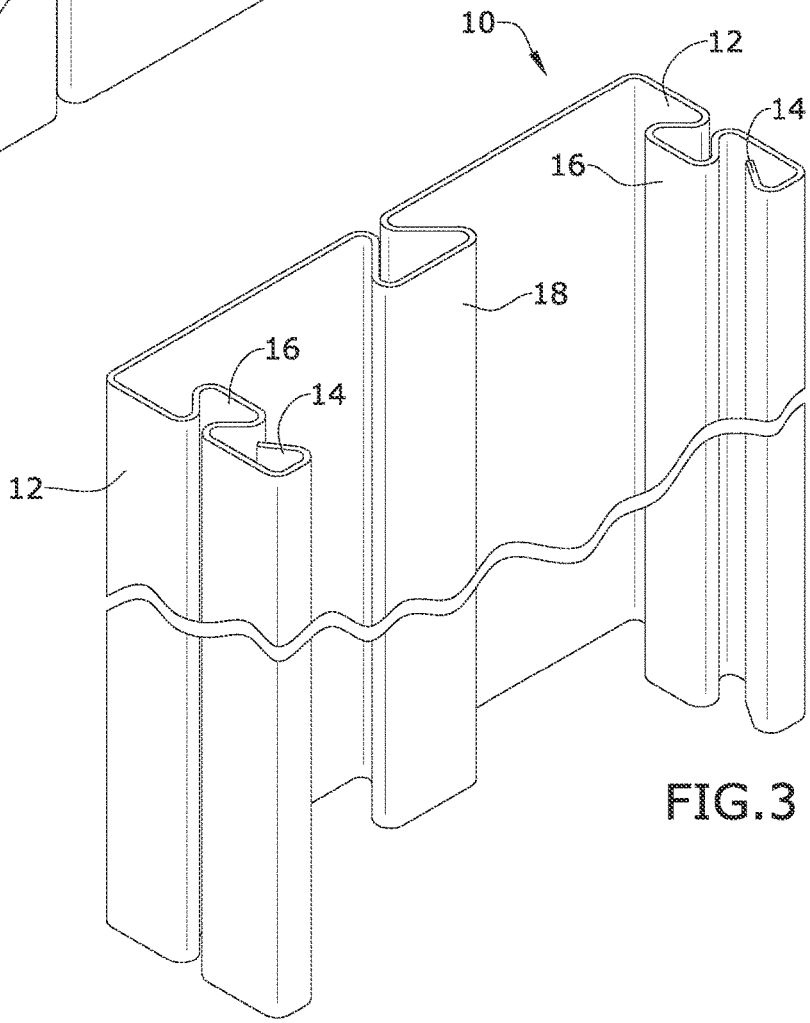
FIG. 3 is a rear perspective view thereof.

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, one embodiment of the present invention is a stud constructed with bends that form triangular longitudinal channels. These longitudinal channels increase the axial capacity by 260% and the moment capacity by 45% compared to a currently available 25-, 20-, 18- and 16-gauge "CEE" stud having otherwise like dimensions.

The inventive stud may be used in and with surrounding materials to build a wall system. This convoluted stud design may also be used as a joist for a ceiling and roof system. However, the stud's use is not limited to building construction. In aeronautics, it may be used as a spur in an airplane wing design. In aerospace, the stud may be used as a space shuttle tank "stringer" in the shell wall design. The stud may be used in the automotive industry in frame and chassis design. Sea container walls may be supported with the inventive stud. The inventive studs may also be used as ship hull beams, deck beams, and longitudinal beams and as submarine cross stay frames. As is apparent from the wide range of uses, the studs may be structural or non-structural in nature.

The inventive one-piece or unitary stud has two end longitudinal side portions joined with a central longitudinal side portion. Each of the longitudinal side portions and the longitudinal central portion are formed of two parallel planar surfaces having equal dimensions with a gapped acute isosceles triangular channel therebetween, i.e., midway along the respective stud portion. The two longitudinal side portions each have a free edge bent into a gapped right isosceles triangle. In other words, each of the isosceles triangles have a corner gap where the sides of the triangle do not touch. To form the various sides and triangles, the material has eighteen bends.

The material of manufacture is not particularly limited and may be a metal or an injection molded plastic but is generally any suitable ductile and/or malleable metal. In embodiments utilizing metal, the metal may be, for example, steel, aluminum, and/or titanium. The stud may be strengthened with carbon fiber. Suitable types of steel may include, e.g., ASTM A-36, 33 ksi for non-structural use and 50 ksi for structural use. In embodiments utilizing steel, the stud may have any suitable thickness, such as from 10 gauge (0.1242 inch or 118 mil) to 25 gauge (0.0843 inch or 18 mil), depending in part upon whether the function is structural or non-structural.

A method of making a stud according to an embodiment of the present invention comprises, for example, cold forming including applying bends to a flat elongated metal sheet. The dimensions are not limited to the dimensions shown below. All bends in the example stud are rounded, with a radius of 0.0849 inches.

TABLE 1

Bend dimensions in an example stud

| Step | Segment Length, inches | Angle, degrees[1] |
|---|---|---|
| 1 | 0.50 | 135° |
| 2 | 0.50 | −90° |
| 3 | 1.00 | 0° |
| 4 | 0.75 | 135° |
| 5 | 0.95 | 0° |
| 6 | 0.75 | −135° |
| 7 | 1.00 | 0° |
| 8 | 3.00 | 90° |
| 9 | 1.00 | 225° |
| 10 | 1.25 | 90° |
| 11 | 1.00 | 315° |
| 12 | 3.00 | 90° |
| 13 | 1.00 | 180° |
| 14 | 0.75 | −45° |
| 15 | 0.95 | 180° |
| 16 | 0.75 | 45° |
| 17 | 1.00 | 180° |
| 18 | 0.50 | 270° |
| 19 | 0.50 | 35° |

[1]The angles disclosed are incremental, with 0° indicating North or straight up and 90° indicating East or to the right. In other words, The first length of 0.50 inches extends from a starting point to a point Southeast thereof. The sheet is bent 45° (135 − 90 = 45) and extends a length of 0.50 inches.

Figure 4:
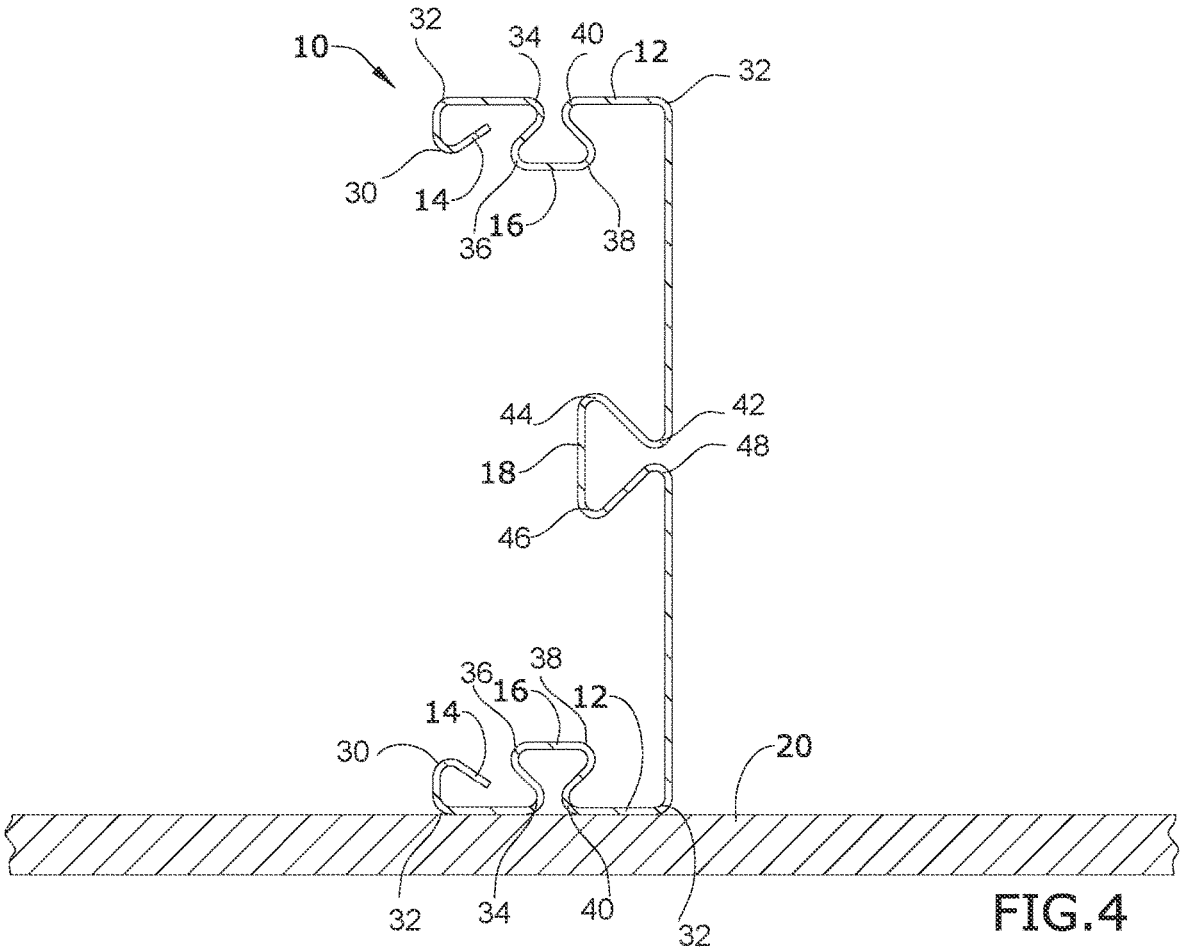
FIG. 4 is a sectional view taken along 4-4 in FIG. 1.

Referring to FIGS. 1 through 4, FIG. 1 illustrates a wall 20, cut away to show studs 10 according to an embodiment of the present. As more clearly seen in FIGS. 2 and 3, each stud has a central or middle bend 18 joining two parallel planar central surfaces 24, which each curve at an opposite corner 32 to form a flange 12. The flanges 12 each have a side bend 16 joining two parallel planar flange surfaces 22. Distal to the corner 32 joining the first two planar surfaces, each flange curves along two angles 30, 32 to form a return lip 14. Each of the bends 16, 18 has four corners 34, 36, 38, 40 and 42, 44, 46, 48, forming a rounded triangular shape with a gap at one vertex. Each of the bends 16, 18 is equidistant between 90° corners 32 at ends of the planar surfaces. As shown in FIG. 4, a wall or wallboard 20 may be fastened to one of the flanges 12. The opposing flange 12 may attached to another component of the structure.

It should be understood, of course, that the foregoing relates to exemplary embodiments of the invention and that modifications may be made without departing from the spirit and scope of the invention as set forth in the following claims.

What is claimed is:

1. A unitary stud, comprising:

a central longitudinal side formed of a first planar surface with a first end, a second planar surface with a second end, the first planar surface and the second planar surface joined by a central acute isosceles triangular channel midway between the first end and the second end;

a first longitudinal side joined at a 90° angle to the first end of the central longitudinal side and having a third end opposite the first end, wherein the first longitudinal side is formed of a third planar surface and a fourth planar surface, the third planar surface and the fourth planar surface joined by a first side acute isosceles triangular channel midway between the first end and the third end, wherein the third end forms a first gapped right triangle; and a second longitudinal side joined at a 90° angle to the second end of the central longitudinal side and having a fourth end opposite the second end, wherein the second longitudinal side is formed of a fifth planar surface and a sixth planar surface, the fifth planar surface and the sixth planar surface joined by a second side acute isosceles triangular channel midway between the second end and the fourth end, wherein the fourth end forms a second gapped right triangle;

wherein the unitary stud has a substantially C-shaped cross section; and wherein the first planar surface and the second planar surface are each longer than the third planar surface, the fourth planar surface, the fifth planar surface, and the sixth planar surface.

2. The unitary stud of claim 1, wherein corners are rounded.

3. The unitary stud of claim 1, wherein the first planar surface and the second planar surface have equal dimensions.

4. The unitary stud of claim 1, wherein the third planar surface and the fourth planar surface have equal dimensions.

5. The unitary stud of claim 1, wherein the fifth planar surface and the sixth planar surface have equal dimensions.

6. The unitary stud of claim 1, wherein the central acute isosceles triangular channel has a corner gap where a first side of the central acute isosceles triangular channel joins the first planar surface and a second side of the central acute isosceles triangular channel joins the second planar surface.

7. The unitary stud of claim 1, wherein the first side acute isosceles triangular channel has a corner gap where a first side of the first side acute isosceles triangular channel joins the third planar surface and a second side of the first side acute isosceles triangular channel joins the fourth planar surface.

8. The unitary stud of claim 1, wherein the second side acute isosceles triangular channel has a corner gap where a first side of the second side acute isosceles triangular channel joins the fifth planar surface and a second side of the second side acute isosceles triangular channel joins the sixth planar surface.

9. The unitary stud of claim 1, wherein the unitary stud is made of metal.

* * * * *